US008810415B2

(12) United States Patent
Grundler et al.

(10) Patent No.: US 8,810,415 B2
(45) Date of Patent: Aug. 19, 2014

(54) EVACUATION SYSTEM AND ESCAPE ROUTE INDICATOR THEREFORE

(75) Inventors: Gottfried Grundler, Salzburg (AT); Georg Franz Wagner, Berchtesgaden (DE); Ulrich Constantin Wagner, Berchtesgaden (DE)

(73) Assignee: Elektro Grundler Ges.m.b.H. & Co. KG, Salzburg (AT)

( * ) Notice: Subject to any disclaimer, the term of this patent is extended or adjusted under 35 U.S.C. 154(b) by 695 days.

(21) Appl. No.: 12/735,188

(22) PCT Filed: Dec. 15, 2008

(86) PCT No.: PCT/EP2008/010643

§ 371 (c)(1),
(2), (4) Date: Aug. 20, 2010

(87) PCT Pub. No.: WO2009/080234

PCT Pub. Date: Jul. 2, 2009

(65) Prior Publication Data

US 2010/0309004 A1 Dec. 9, 2010

(30) Foreign Application Priority Data

Dec. 20, 2007 (DE) ..... 10 2007 061 754

(51) Int. Cl.
*G08B 17/00* (2006.01)

(52) U.S. Cl.
USPC ..... 340/588; 340/330; 340/332; 340/501; 340/506; 340/521; 340/524; 340/628; 340/632; 340/691.1; 340/815.4

(58) Field of Classification Search
USPC ..... 340/588, 332, 501, 506, 521, 524, 628, 340/632, 691.1, 815.4, 330
See application file for complete search history.

(56) References Cited

U.S. PATENT DOCUMENTS

| | | | | |
|---|---|---|---|---|
| 6,998,960 | B2 * | 2/2006 | Buschmann et al. | 340/286.05 |
| 7,592,923 | B2 * | 9/2009 | Lax | 340/628 |
| 7,683,793 | B2 * | 3/2010 | Li et al. | 340/628 |
| 7,948,368 | B2 * | 5/2011 | Huber | 340/506 |
| 2007/0194922 | A1 * | 8/2007 | Nathan et al. | 340/572.1 |
| 2009/0102619 | A1 | 4/2009 | Blohberger et al. | |

FOREIGN PATENT DOCUMENTS

| | | | |
|---|---|---|---|
| CH | 696 048 | A5 | 11/2006 |
| DE | 196 44 127 | A1 | 4/1998 |
| DE | 197 22 406 | A1 | 12/1998 |
| WO | WO 2006/086812 | A2 | 8/2006 |

OTHER PUBLICATIONS

International Search Report dated Jun. 22, 2009 for corresponding PCT Application No. PCT/EP2008/010643.

* cited by examiner

*Primary Examiner* — Tai T Nguyen
(74) *Attorney, Agent, or Firm* — Miller, Canfield, Paddock, and Stone; Mark L Maki

(57) ABSTRACT

An object, for example a building, is divided into different sections. Each section comprises a plurality of computers, each controlling an individual escape route display or a group of escape route displays. The computers are controlled by monitoring sensors of the object section. The blueprint of the object section and a control algorithm for the safest escape route from the object section is stored in the computers. The invention further relates to an escape route display that can be used for a device of said kind.

39 Claims, 2 Drawing Sheets

EVACUATION SYSTEM AND ESCAPE ROUTE INDICATOR THEREFORE

FIELD OF INVENTION

The present invention relates to a system and apparatus for evacuating buildings or objects of property in which persons are present, especially buildings, shopping centre, industrial facilities, tunnels and other underground engineering works, as well as ships, as stated in the pre-characterizing portion of patent claim 1. In addition, it relates to an escape route indicator for an evacuation system of this aforesaid kind.

BACKGROUND OF THE INVENTION

A system and apparatus of this kind has been known by WO 2006/086812 A2, where supervisory sensors and escape route indicators are connected through a cable harness with a central computer installation in the property. In case of fire, the cable harness may be damaged so that the evacuating system is put out off operation.

It is the aim of the invention to provide a safe evacuating system and apparatus for property objects of the aforesaid kind.

In accordance with the invention, this aim is attained by apparatus as characterized in claim 1. Advantageous further developments of the invention are presented in the dependent claims.

SUMMARY OF THE INVENTION

The inventive apparatus is intended for the evacuation of property objects of any kind in which persons are present, especially of buildings such as high-rises, railroad stations, airport buildings or shopping centre, but also for industrial facilities, tunnels or other underground civil engineering works, as well as ships of the like. The emergency event may include fires, terrorist attacks or the like.

In accordance with the invention, the property object is divided into a plurality of sections, with each escape route indicator in the individual sections having associated therewith a computer means, which may be coupled to the supervisory sensors of the respective object section. To this end, each escape route indicator of the object section may comprise a computer means integrated therein.

Instead of providing each escape route indicator of an object section with computer means, such computer means may be used to control the escape route indicators of a section in groups of two or three.

The computer means provided for the escape route indicators or groups thereof may comprise a microprocessor equipped with a memory chip as a simple and low-cost solution. In this manner, the invention provides an object section with a de-centralized escape guidance system in which the computer means co-operates with the supervisory sensors on the basis of the emergency situation detected by the latter to so control the associated escape route indicators that safe evacuation of the respective object section becomes possible even if the data links to all other sections of the object are disrupted.

The escape route indicators may be safety and exit luminaries as described in DE 197 22 406 B4, for example, which comprise a display panel for the selective display of at least two rescue symbols such as arrows pointing in different directions.

The escape route indicators of the inventive apparatus may comprise other controllable indicators and, especially, optical or acoustic indicating elements—for example, floor markers such as as transversely extending luminous bars recessed into the floor or other luminous means such as luminous bands or stripes recessed into the floor and energized sequentially in the manner of a running light.

The supervisory sensors may be fire sensors—i.e. and especially smoke or heat sensors—and this in addition to air flow sensors for the detection of the propagation of smoke from a fire.

In an industrial facility, supervisory sensors may be configured to detect hazardous materials such as combustible or toxic gases. Also, and for counterrorism uses, supervisory sensors may be provided which are capable r of detecting explosives, biological substances and/or radioactive radiation.

Further, and again for counterterrorism uses, supervisory sensors may be designed to detect dangerous objects. For example, cameras may be provided with image detection capabilities to detect persons leaving a deposited object such as a suitcase. Further, the sensors may comprise microphones for the detection of panic noises and, in addition to the supervisory sensors, each section of the building under surveillance may have emergency alarms—such as fire alarms—installed therein.

Within the meaning of the invention, "emergency" includes an alarm event or a situation of need.

The supervisory sensors which may be used in accordance with the invention include person sensors for the detection of the number of persons who use some specific escape route in an emergency. Such person sensors may comprise pressure sensors recessed into the floor or devices detecting passing individuals by means of a high-frequency Doppler effect whereby, in addition to the number of person passing the person sensors, their direction of movement may be determined.

Moreover, the inventive apparatus may be used for identifying and closing off endangered zones in an object section. To this end, actuators may be provided to drive appropriate means in the object section. Such means may be a door, a window or the like device for closing off an access or egress opening under control by the de-centralized computer of the object section. Such means may include elevators, escalators or the like passenger transport devices which are designed to be activated or de-activated by means of an actuator under control from the computer of the respective object section.

An endangered zone may be identified by means of the same indicators which prescribe the direction of evacuation. In particular, such use may include symbols and signs representing warnings and alarms.

The object section equipped in accordance with the invention generally is a clearly delimited one—such as, in the case of a shopping centre, a building separated from other structures by fire walls or fire doors or, inside a building, a storey or an area separated from other parts of the building by fire protection walls, fire doors or the like measures.

In addition to escape route indicators, the object section preferably is equipped with indicators conveying information directed to personnel engaged in rescue operations. Rescue deployment path indicators may be used to route rescue personnel such as firefighters to areas of engagement. Also, such indicators may be used to signal situations of danger to rescue personnel.

Like the escape route indicators, rescue deployment route indicators may be provided singly or in groups with computer means connected through data links with the supervisory sensors of the respective object section. The computer means associated with each escape route indicator, or any group thereof, may preferably be the computer means assigned to indicate routes of deployment to rescue personnel. This especially where the rescue deployment indicators are disposed near single or grouped escape route indicators comprising computing means as the data links between the rescue deployment indicators and the computer may then be minimized.

Thus, the rescue deployment indicators may be located on the rear surface of an escape route indicator projecting from a ceiling or wall into the escape route, for example. Also, and like escape route indicators, rescue deployment indicator may be designed as LED indicators but show another symbol.

For enhanced safety, each single or grouped escape and/or rescue deployment route indicator of an object section may be provided with a power supply of its own, such as a rechargeable battery. If located near a single or grouped escape route indicator, the power supply thereof—such as a re-chargeable battery—may be used to serve the rescue deployment route indicator also.

The data link provided between the computer installation, the supervisory sensors, the escape route indicators and the rescue deployment path indicators (if used), may be a radio link or a signaling line such as a wire or fiber optics line.

Preferably, the data link for the sensor signals from the supervisory sensors to the object section's computer is designed to be redundant. Redundancy may be achieved by using two physically different data transmission paths such as a radio link on the one hand and a wire or fiber optics link on the other. Thus, in a terrorist attack, and unlike a signaling line, a radio link is easily disabled by jamming; conversely, in a fire, a signaling line is destroyed more quickly than a radio link.

Instead, redundancy may be generated by means of a ring line which interconnects the supervisory sensors, the computer means and any actuators (if used). This results in each computer means, supervisory sensor and actuator (if any) in the object section to be connected by two lines, i.e. a bidirectional connection exists in which each input to a computer means, supervisory sensor and actuator constitutes an output, and vice versa. The ring line may consist of fire-retardant cable. The inventive redundancy of the data link amounts to a substantially enhanced resilience of the inventive apparatus against failure.

It is preferred to provide data links between neighboring object sections. This way, an object section where an emergency has occurred may issue a signal to the adjacent object section so as to switch an escalator, for example, in the adjacent object section to the escape direction of the persons to be evacuated in an emergency and/or to switch another escalator in the adjacent object section to the direction of deployment of rescue personnel towards the endangered area.

The object section equipped in accordance with the invention may include another computer means configured to operate as an interface to a communications and control centre or to document the emergency, i.e. a computer to collect and memorize the information from the supervisory sensors. Such other computer means may be used for permanent monitoring and surveillance also.

In each computer of the object section, the memory chip is used, for example, for storing a plan of the object section, i.e. a ground or floor plan of the building portion to be evacuated in an emergency. Further, the computer may store a control algorithm defining the safest escape route from the object section and, in case the object section has rescue deployment paths laid out in it, the rescue deployment path complementary to the safest escape route from the object section.

Route control may be based on the Dijkstra algorithm or on any other routing algorithm for computing the shortest escape route. The shortest escape route is computed on the basis of vertexes and edges. A vertex is defined to be an exit from or a point in the object section where a rescue deployment or escape route indicator is located, whereas edges are formed by the path between two vertexes. Further, an edge may have a supervisory sensor—especially an emergency sensor such as a fire sensor or a sensor for the detection of hazardous substances or objects—associated therewith so that the path cannot be used any longer if at least one supervisory sensor associated with it emits emergency signals.

Where emergency alarms—such as fire alarms—are located in the object section, these may be associated with the edges, i.e. they may close off a path in case at least one emergency alarm associated with that path has been activated.

It is preferred for the edges to be weighted in accordance with suitability for evacuation, i.e. especially with the maximum possible throughput of persons per unit time. For example, a broader passage, exit, flight of stairs or the like may be assigned a greater weight than a narrow passage, etc.

In addition, such weighting may be dynamic in nature—e.g. in case the object section has sensors to determine the number of persons escaping along a path between two vertexes, i.e. along an edge, per unit time. Where a danger exists of an escape route getting congested, the control algorithm may be employed to indicate several escape routes so as to divide the flow of escaping persons among several escape routes.

Also, and preferably, the routing algorithm may be used to determine not the shortest but the safest escape route. This is possible by object sections communicating local conditions among themselves. In particular, two or more escape routes may be determined—which is important if the number of persons to be evacuated requires evacuation along two or more paths and/or a deployment route must be kept free for approaching rescue personnel.

If the number of persons to be evacuated from the endangered section or another object section exceeds some specific number, that number may be taken into account by the routing algorithm specifying alternate escape routes so as to avoid congestion in narrow passages, flights of stairs or other points of constriction. This may in fact result in escape routes being proposed which are much longer, but safer than the shortest escape route computed first.

In order to provide escaping persons and/or incoming rescue personnel with an overview of the escape and/or rescue deployment routes available in the object section, a panel or the like display element may be set up in the object section to indicate the floor or ground plan of the object section and the escape route(s) or rescue deployment path(s) available. The rescue deployment or escape route overview is preferably connected to the data link serving the respective section. For example, such overview may be designed as an LED display. To provide rescue personnel located outside the object section with an overview of the rescue deployment paths, the data link may be in the form of a radio link.

As mentioned above, at least one computer in the object section may provide for permanent surveillance and documentation so as to determine endangered or failed escape and/or rescue deployment route indicators and/or endangered or failed data links. This makes possible the signaling of an imminent internal fault condition. Fault alarms regarding endangered or failed rescue deployment or escape route indicators may be signaled to a control centre or on-line via the internet to an internet address.

Failure of a rescue deployment or escape route indicator may be distinguished from the failure of a data link by means such as the regular polling thereof, i.e. the fiberglass and/or copper line or the radio link. Failure of a rescue deployment or escape route indicator may be taken into account in route computing.

In case the indicator comprises luminous means, failure of such luminous means may be signaled as well. Such luminous means may be any electric source of light, e.g. LEDs or lamps such a halogen lamps, incandescent lamps, fluorescent tubes or the like. In case a pre-determined number of luminous means—such as LEDs—fails, the rescue deployment or escape route indicators may be de-activated by the associated computer so as to avoid misinterpretation.

It is preferred for computer installations receiving input from supervisory sensors to store a software program for preconfigured emergency scenarios. In this situation, the possibility exists of storing in the computer a plurality of preconfigured emergency scenarios. To this extent, a de-centralized evacuation scheme for an object section is safer because it is typical in a damage event that a single section fails, not several of them simultaneously. Thus, it is possible to pre-simulate smoke gas propagation scenarios, for example, for computer storage in the form of a table which represents the changes in time of the endangered area in dependence on the origin of the first cause of danger.

If, now, a sensor such as a smoke detector responds at some specific location, several plausible alarm events must be checked to then select from the computer's memory a precalculated danger propagation scheme suitable to be incorporated in the escape route computation. It is possible for escape routes to undergo change in time on the basis of a "worst case" scenario, however, even if no new input from sensors is present. This intelligent redundancy creates safety even if a fire alarm system (external or internal signaling) fails because such system may be implemented to be self-controlling at least in parts. In the process, the priority of additional alarm signals that may arrive and trigger new routing computations should be taken into account if alarm events elsewhere become known by manual or sensor signaling.

For preventive evacuation, one or more pre-stored case-dependent standard evacuation scenarios may be made available. The scenario applicable in the individual case may be called up when activated by a key switch or by code input, for example, and the respective routing scheme output to the rescue deployment and escape route indicators.

Also, the need of evacuation, and the escape of persons from a danger area, may occur in a bank as a result of a hold-up alarm. In this case, a pre-configured routing scheme may be used a manner similar to preventive evacuation. In the case of a bank hold-up, a particular characteristic of the alarm is the absence of acoustic means. Evacuation may then be triggered by a hidden emergency button actuatable by a bank employee, for example.

To avoid collision and congestion, the routing algorithm may be implemented to allow rescue personnel to activate at the fire alarm centre or the control unit a condition designed to conduct persons to be evacuated away from the point where such personnel wants to enter the object so as to secure their deployment route.

Preferably, the inventive evacuation apparatus is designed to use an escape route indicator having a casing provided with a display panel (including but not restricted to lights showing standardized rescue symbols). The casing may accommodate the computer means associated with the escape route indicator and, additionally and preferably, an autonomous power supply such as dry cells or a re-chargeable battery disposed in or next to the indicator.

The dry cells or re-chargeable battery are provided mainly for emergency power. As long as no alarm is triggered, power may be provided by the mains grid.

The computer means preferably comprises a microprocessor and a memory. Further, escape route indicators are preferably provided with an input and an output each to lay out a ring line to which the computer means of the other escape route indicators of the respective object section are coupled, as are any sensors and the like for data communication.

The indicator display panel preferably comprises one or more light sources—such as LEDs—driven by the computer means of the escape route indicator.

The escape route indicator is preferably provided with at least one sensor, which may be located inside or on the indicator casing. Further, the escape route indicator may be provided with an interface such as a plug-in connector to accept a sensor and/or the ring line and/or a fire alarm or the like.

The sensor may comprise a smoke sensor, a temperature sensor and/or a luminance sensor. The sensor creates two properties useful for the inventive escape route indicator. On the one hand, the indicator may now recognize a hazard and react to it by an alarm signal internal to the object section to be evacuated, such as a storey or a staircase inside a building. On the other hand, and initially locally and then in cooperation with other escape route indicators in the section where no smoke but an elevated temperature has been detected, the indicator may compute the escape route which is best at that time. This escape route may change on very short notice, however. Still, an enhanced dynamic escape route indication is obtainable in this manner.

The luminance or brightness sensor preferably incorporated in the escape route indicator may be used to regulate the brightness of the light sources in the indicator display panel. Thus, the computer means may drive the light sources in the indicator display panel to radiate at 5 to 50%, and preferably less than 20%, of their maximum under normal ambient light conditions so as to spare the indicator power supply. In the event of an alarm the brightness of the light sources is stepped up, i.e. preferably to 70 to 90% of their maximum for a smoke-free event and to maximum for a smoke-generating event.

At the same time, the luminance sensor may be used for signaling an open fire, which is known to flicker. An open flame flickers because the transport of oxygen to the flame is not uniform so that the combustion reaction is not stationary. Instead, oxygen depletion causes air to rush in towards the flame, causing it to again grow and become brighter almost instantly. Once the local combustion reaction in the flame has decayed, the flame becomes smaller and its brightness decreases. This reaction of rapid brightness fluctuation typically lasts 300 to 800 milliseconds and may be detected mathematically by evaluating the fluctuation frequency. Once a brightness change so fast has been detected, the escape route indicator may at least issue an advance warning signal. Computation is done by the computer means in the escape route indicator, such as the microprocessor. As the latter includes data memory, all that is needed is an implementation of the required software.

Alarm systems are beset with the problem of preventing false alarms. Allowable combustion-induced changes of brightness may be selected via pre-settable limits and a corresponding algorithm, which, in connection with the typical frequency of the flickering fire, amounts to a significant improvement of the inventive escape route indication scheme. It should be taken into account also that often an incipient fire will not develop much smoke, but will flicker from the outset and become increasingly brighter as it burns.

The computer means of the inventive escape route indicator may be provided with logic programmed to generate an advance warning signal. In other words: Should the temperature sensor in an escape route indicator detect an imminent failure condition, that likelihood may be signaled beforehand. The computer means may be equipped with a real-time clock and be configured to issue the advance warning signal if a predetermined temperature is exceeded and that condition has lasted a pre-determined period of time. If, for example, the pre-determined temperature is set to 40° C. and the temperature sensor of the escape route indicator has measured a temperature higher than 40° C. before and after a given period of time, an advance warning signal may be issued. Such signal will not be issued, then, if the temperature drops back below 40° C. within a period of, say, 100 seconds. The background of this measure is the inability of electronics to survive overheating for extended periods of time. Should the brightness sensor signal that light from the sun or a spotlight is impinging on the display panel, i.e. that the incident light does not flicker, no over temperature alarm will be triggered. As a result, the inventive escape route indicator will—by its sensors—recognize a danger trend and may signal it elsewhere for evaluation.

The smoke sensor of the inventive escape route indicator may be designed to distinguish low-concentration smoke, which does not impair visibility, from highly concentrated smoke, which is next to impenetrable. To this end, the smoke detector may comprise an LED or other light source for long-wave (e.g. red) light and one for short-wave (e.g. blue) light so as to provide for smoke particle size discrimination.

The pressure sensor may be a point sensor in front of a door or in a threshold to detect persons. Further. the escape route indicator may comprise a sensor for recognizing the direction of a flow of persons. The latter sensor may be an ultrasonic sensor or an RF microwave Doppler sensor, for example.

Further, the inventive escape route indicator may comprise a fire alarm device suited for manual actuation—such as a fire alarm button.

Besides, the inventive escape route indicator may include a loudspeaker. In this respect, the computer means of the escape route indicator may comprise speech memory means adapted to be activated by a sensor, such as a smoke or temperature sensor. This because voice announcements are audible in strongly smoked-up environments also. Speech memories may be designed to sound different announcements, depending on the evaluation and logical combination of outputs from various sensors.

Further, the inventive escape route indicator may comprise a video camera, whereby image processing may be applied by the computer means to recognize situations of danger.

The display panel provided with light sources opens opportunities of conveying advice which may substantially exceed the word "Closed" or the like brief bits of information. In particular, the sequential driving of light sources may generate a kind of "type crawl". In addition, the computer means may comprise text memory so as to allow different texts to be displayed by type crawl—such as the distance to the next exit. Also, the light sources may be designed to be driven sequentially so as to form a running light.

As escape route indicators should be clearly perceivable to handicapped persons, an alarm should cause the light sources to be driven to pulsate between bright and dim or with their brightness rising and ebbing.

Preferably, the escape route indicator is designed to technically match the place where it is to be set up or suspended. This applies to the sturdiness of the casing and of the display panel, for example, with the indicator, if installed at some small height above the floor, to be shock-proof and waterproof as well. In contrast to buildings, where escape route indicators may be installed at overhead locations, signaling means are usually mounted a short distance above the floor in tunnels. Accordingly, in tunnels, the inventive escape route indicator may be installed near the floor.

The inventive escape route indicator constitutes a—standardized—safety sign with or without safety lighting. The escape route indicator may be driven by a fire alarm triggered by radio, and this alternatively to a line such as copper. In this case, the escape route indicator may work as fire signaling means in case a fire alarm system is not mandatory for the respective building or other property. Rescue deployment routes may be laid out and provide signals the same way as are the escape route indicators. In accordance with the invention, the indicators may be bidirectional, i.e. located in the building section in the escape route direction on the one hand and in the rescue deployment direction on the other, with the computing means of the latter storing a ground or floor plan of the building section and a control algorithm for the most efficient deployment route.

BRIEF DESCRIPTION OF THE DRAWINGS

An embodiment of the inventive apparatus and an inventive escape route indicator is illustrated below under reference to the attached drawings.

DETAILED DESCRIPTION

Figure 1:
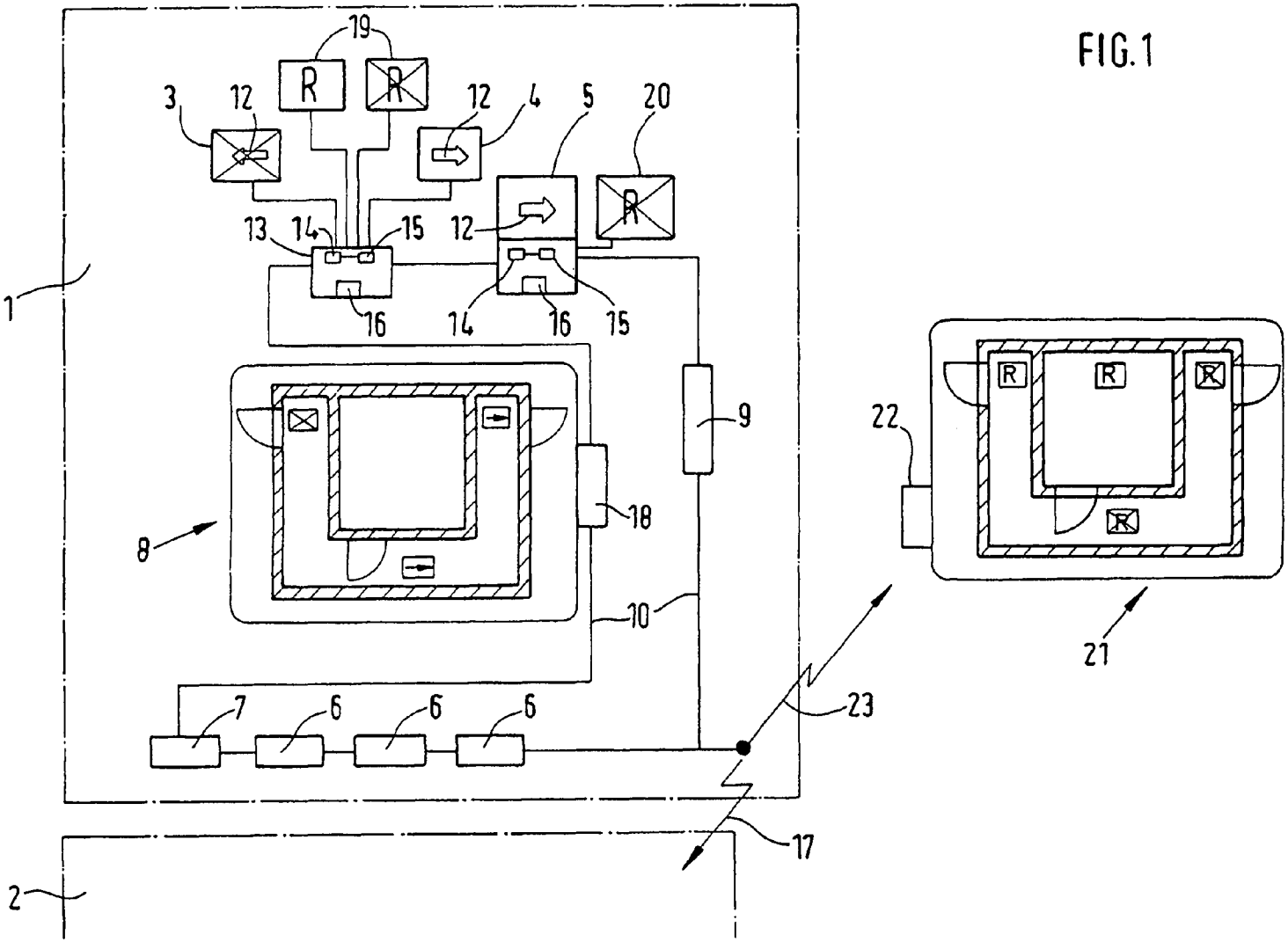
FIG. 1 shows a schematic view of apparatus for evacuating a multi-storey building.

As shown in the drawings, the building has two fire sections 1, 2. As illustrated by fire section 1, each fire section is equipped with escape route indicators 3, 4, 5, supervisory sensors 6, one or more actuators 7, an escape route overview display 8 and a documentation computer system 9.

Escape route indicators 3, 4, 5, supervisory sensors 6 or actuators 7, the escape route overview display 8 and the documentation computer 9 are interconnected by a ring line 10.

Escape route indicators 3, 4, 5 each have a display surface provided with light emitting diodes, for example so as to make possible the showing of different safety signs 12, such as arrows pointing in different directions.

Each escape route indicator 3, 4, 5 of each fire section 1, 2 has associated therewith a computer 13 which may comprise a microprocessor 14 and a memory chip 15 and is connected to ring line 10 via an input and an output each. Further, each escape route indicator 3, 4, 5 has a re-chargeable battery or a similar autonomous power supply 16, which may power the supervisory sensors 6 through ring line 19 as well, for example. The actuators 7, the escape route display 8 and the documentation computer system 9 may have a power supply of their own.

Instead of a computer 13 in each escape route indicator 3, 4, 5, a computer 13 with a power supply 16 may be provided to commonly serve a group of indicators, such as escape route indicators 3, 4 of fire section 1.

A plan—such as a floor plan—of fire section 1, 2 is stored in each computer 13, i.e. its memory chip 15. Further, each computer 13 stores the control algorithm for the safest escape route from section 1, 2, which is used for driving escape route indicators 3, 4, 5 for displaying various safety symbols 12.

Ring lines 10 of each section 1, 2 are interconnected by a data link, which may be configured to be a radio link, for example.

Escape route overview display 7 may be designed to be an LED display showing the floor plan of fire section 1, 2 as well as the escape route determined by computer means 13.

Computer 13 of escape route indicators 3, 4 may have rescue deployment route indicators 19, 20 connected thereto. Also provided is a rescue deployment route overview display 21 similar in configuration to escape route overview display 7 and showing a rescue deployment route complementary to the route shown by escape route overview display 7. Rescue deployment route overview display 21 is connected with computer 22 and with ring line 10 by radio, for example.

Figure 2:
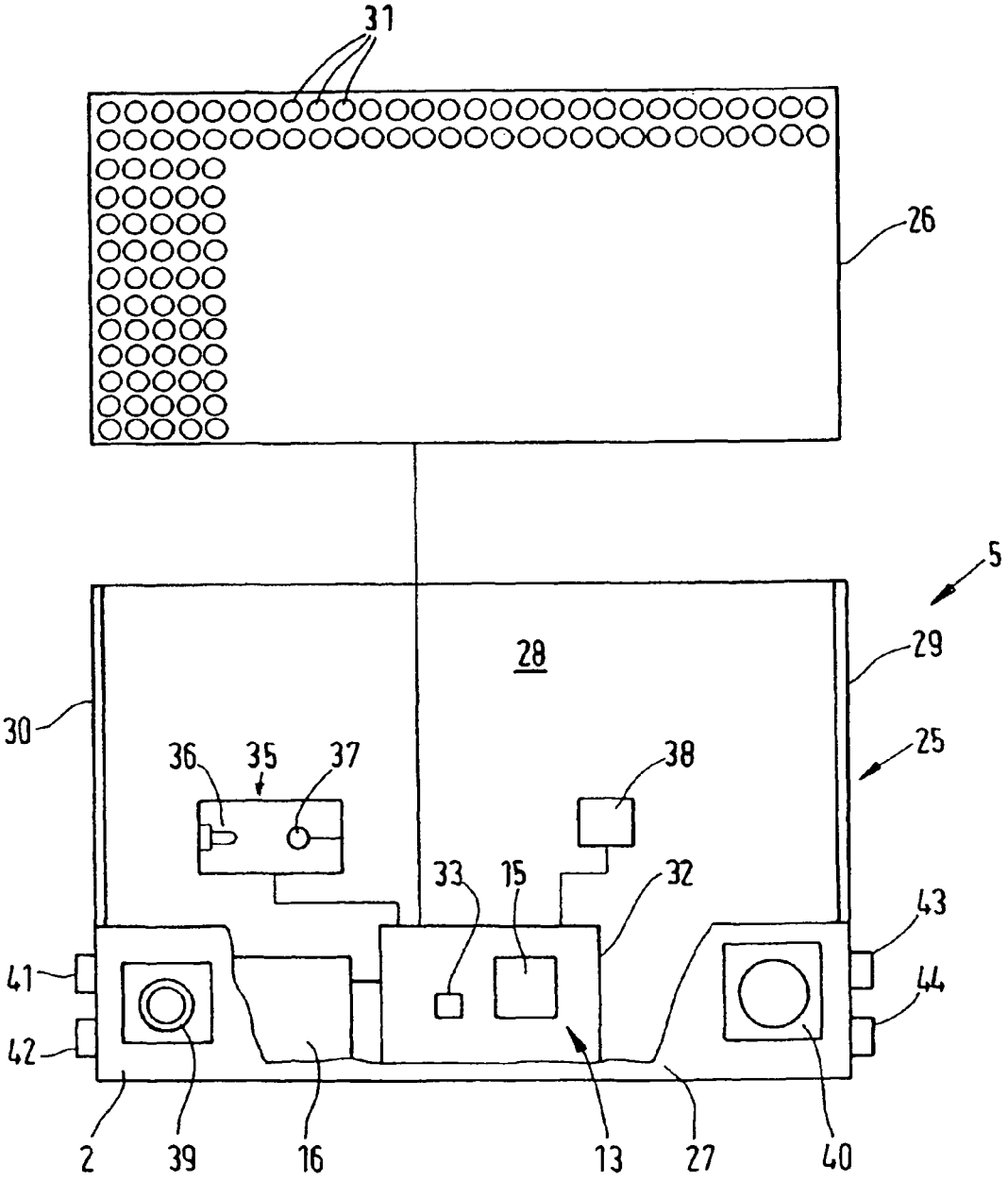
FIG. 2 shows a front view of an escape route indicator with the display panel removed and parts broken away.

Escape route indicator 5 of FIG. 2 has a casing 25 on which a display panel 26 may be mounted. Casing 25 has a front wall 27 below display 26, a rear wall 28 and two side walls 29, 30.

Display panel 26 has thereon a plurality of LEDs and/or other light sources 31 soldered to a printed wiring board (PWB) bearing suitable conductors. Display panel or PWB 26 is driven by computer 13 which itself comprises a PWB 32 carrying microprocessor 15. PWB 32 also has a real-time clock 33 thereon. For power, casing 25 also houses a battery 16; alternatively, a re-chargeable battery may be provided externally.

Further, casing 25 houses a smoke sensor 35 comprising two LEDs 36 as light sources and a light receiver 37, as well as a temperature sensor 38. Smoke sensor 35 and temperature sensor 38 provide input signals to computer means 13.

A video camera 39 and a loudspeaker 40—also connected to computer 13—are mounted in front wall 27.

Further, side walls 29, 30 and/or the rear wall may have plug-in connectors 41 to 44 therein to connect ring line 10 (FIG. 1) to computer 13, for example. Further, connectors 41 to 44 allow additional sensors—such as pressure sensors, but also fire sensors, etc. —to be connected to computer 13.

The invention claimed is:

1. Apparatus for an emergency evacuation of a property object where persons are present, comprising escape route indicators (3, 4, 5), supervisory sensors (6), computer means (13) adapted to drive said escape route indicators (3, 4, 5) based upon data from said supervisory sensors (6), and a data connection running between said computer means (13), said supervisory sensors (6) and said escape route indicators (3, 4, 5), characterized by said property object comprising a plurality of object sections (1, 2) and each said object section (1, 2) of the property object having a plurality of said computer means (13) each driving a single one of said escape route indicators (3, 4, 5) or a group of said escape route indicators (3, 4, 5) provided in said object section (1, 2), said computer means (13) of said object section (1, 2) receiving input from said supervisory sensors (6) associated with said object section (1, 2), and with said computer means (13) of each said object section (1, 2) storing at least a ground plan of said object section (1, 2) and a control algorithm for a safest escape route from said object section (1, 2).

2. Apparatus as in claim 1, characterized by a plurality of said object sections (1, 2) being provided, and a data link (17) provided between said neighboring object sections (1, 2).

3. Apparatus as in claim 2, characterized by the data link comprising a ring line in said object section (1, 2).

4. Apparatus as in claim 2, characterized by the data link being redundant at least in parts.

5. Apparatus as in claim 4, characterized by the data link being configured to be redundant by comprising a radio link and at least one additional data transmission path physically different from said radio link.

6. Apparatus as in claim 1, characterized by actuators (7) for driving object-related means being provided in said object section (1, 2).

7. Apparatus as in claim 1, characterized by said supervisory sensors (6) comprising at least one of fire sensors, sensors for hazardous substances or objects, air flow sensors and person sensors.

8. Apparatus as in claim 1, characterized by each object section (1, 2) defining a fire section.

9. Apparatus as in claim 1, characterized by each said object section (1, 2) comprising additional computer means (9) for at least one of permanent surveillance and documentation of emergency events.

10. Apparatus as in claim 9, characterized by said object section (1, 2) being provided with rescue deployment route indicators (19, 20) for deployment of rescue personnel and said permanent surveillance allowing for detection of any of said escape route indicators (3, 4 or 5) or said rescue deployment route indicators (19, 20), which are endangered or failed, or detection of any data links (10, 17, 23), which are endangered or disrupted.

11. Apparatus as in claim 1, characterized by said computer means (13), which have input from said supervisory sensors (6) coupled thereto, storing software programs for pre-configured emergency scenarios.

12. Apparatus for an emergency evacuation of a property object where persons are present, comprising escape route indicators (3, 4, 5), supervisory sensors (6), computer means (13) adapted to drive said escape route indicators (3, 4, 5) based upon data from said supervisory sensors (6), and a data connection running between said computer means (13), said supervisory sensors (6) and said escape route indicators (3, 4, 5), characterized by each object section (1, 2) of the property object having a plurality of said computer means (13) each driving a single one of said escape route indicators (3, 4, 5) or a group of said escape route indicators (3, 4, 5) provided in said object section (1, 2), said computer means (13) of said object section (1, 2) receiving input from said supervisory sensors (6) associated with said object section (1, 2), and with said computer means (13) of each object section (1, 2) storing at least a ground plan of said object section (1, 2) and a control algorithm for a safest escape route from said object section (1, 2), said object section (1, 2) being provided with rescue deployment route indicators (19, 20) for deployment of rescue personnel.

13. Apparatus as in claim 12, characterized by each rescue deployment route indicator (19, 20) individually or any group of said rescue deployment route indicators in said object section (1, 2) being driven by said computer means storing the ground plan of said object section (1, 2) and a control algorithm for deployment of rescue personnel in said object section (1, 2).

14. Apparatus as in claim 13, characterized by the control algorithm for the rescue deployment route being complementary to the safest escape route.

15. Apparatus as in claim 12, characterized by said computer means (13) being provided to drive individual said escape route indicators (3, 4, 5) or groups thereof in said object section (1, 2) and at a same time serving said rescue deployment route indicators (19, 20).

16. Apparatus as in claim 12, characterized by at least one of each escape route indicator (3, 4, 5), each rescue deployment route indicator (19, 20), a group of said escape route indicators and a group of said rescue deployment route indicators in said object section (1, 2) having a power supply (16) of its own.

17. Apparatus as in claim 12, characterized by an escape route overview display (8) and a rescue deployment route overview display (21) being provided, said displays showing the ground plan of said object section (1, 2) and the escape or rescue deployment routes therein as determined by said computer means (13).

18. Apparatus as in claim 17, characterized by said escape route indicators (3, 4, 5), said rescue deployment route indicators (19, 20), said escape route overview display (8) and said rescue deployment route overview display (21) being LED displays.

19. Apparatus as in claim 12, characterized by the control algorithm being based on vertexes and edges, said vertexes being an exit or a place within said object section (1, 2) where at least one of said escape route indicators (3, 4, 5) and said rescue deployment route indicators (19, 20) is located, and said edges forming the path running between two vertexes.

20. Apparatus as in claim 19, characterized by the edges being weighted in accordance with the throughput of persons there along.

21. Escape route indicator for evacuation apparatus for an emergency evacuation of a property object where persons are present, comprising a plurality of said escape route indicators (3, 4, 5), supervisory sensors (6), computer means (13) adapted to drive said escape route indicators (3, 4, 5) based upon data from said supervisory sensors (6), and a data connection running between said computer means (13), said supervisory sensors (6) and said escape route indicators (3, 4, 5), characterized by each section (1, 2) of the property object having a plurality of said computer means (13) each driving a single one of said escape route indicators (3, 4, 5) or a group of said escape route indicators (3, 4, 5) provided in said object section (1, 2), said computer means (13) of said object section (1, 2) receiving input from said supervisory sensors (6) associated with said object section (1, 2), and with said computer means (13) of each object section (1, 2) storing at least a ground plan of said object section (1, 2) and a control algorithm for a safest escape route from said object section (1, 2), said escape route indicator characterized by being provided with at least one sensor.

22. Escape route indicator as in claim 21, characterized by the sensor comprising a smoke sensor.

23. Escape route indicator as in claim 21, characterized by the sensor comprising a brightness sensor.

24. Escape route indicator as in claim 21, characterized by the sensor comprising a temperature sensor.

25. Escape route indicator as in claim 24, characterized by the computer means being provided with a real-time clock (33) and configured to issue the advance warning signal in case a given temperature is exceeded for a given period of time.

26. Escape route indicator as in claim 21, characterized by said computer means storing program logic for the generation of an advance warning signal.

27. Escape route indicator as in claim 21, characterized by the sensor comprising a pressure sensor.

28. Escape route indicator as in claim 21, characterized by the sensor comprising a sensor for detecting the direction of a flow of persons.

29. Escape route indicator as in claim 28, characterized by the sensor comprising an ultrasonic sensor or an RF microwave Doppler sensor.

30. Escape route sensor as in claim 21, characterized by comprising fire alarm means adapted to be actuated manually.

31. Escape route indicator as in claim 21, characterized by an interface connector for a sensor, the fire alarm means and a ring line (10) for data communication.

32. Escape route indicator as in claim 21, characterized by a loudspeaker (40).

33. Escape route indicator as in claim 21, characterized by a video camera (39).

34. Escape route indicator as in claim 21, characterized by sources of light adapted to be driven by computer means (13).

35. Escape route indicator as in claim 34, characterized by said sources of light being adapted to be driven to pulsate.

36. Escape route indicator as in claim 34, characterized by said sources of light being adapted to be driven sequentially.

37. Escape route indicator as in claim 36, characterized by said sequentially driven sources of light generating a running light.

38. Escape route indicator as in claim 34, characterized by said sources of light comprising electric light sources (31).

39. Escape route indicator as in claim 38, characterized by computer means (13) driving electric light sources (31) so that they emit 5 to 50% of their maximum brightness under ambient lighting conditions, 70 to 90% of their maximum brightness in a smoke-free emergency event and their maximum brightness in an emergency event involving smoke.

* * * * *